US005552564A

United States Patent [19]

Schrader et al.

[11] Patent Number: 5,552,564

[45] Date of Patent: Sep. 3, 1996

[54] RANGE ENHANCEMENT FOR H-SHAPED COMPRESSION CONNECTOR

[75] Inventors: Gary E. Schrader, Londonderry; Armand T. Montminy, Manchester; John Franzini, Salem, all of N.H.

[73] Assignee: Burndy Corporation, Norwalk, Conn.

[21] Appl. No.: 346,235

[22] Filed: Nov. 23, 1994

[51] Int. Cl.[6] ..... H01R 4/18

[52] U.S. Cl. ..... 174/84 C; 174/94 R

[58] Field of Search ..... 174/84 C, 94 R

[56] References Cited

U.S. PATENT DOCUMENTS 3,235,654 2/1966 Eldridge et al. ..... 174/94

3,330,903 7/1967 Holke et al. ..... 174/94

3,387,080 6/1968 Dibble et al. ..... 174/94

*Primary Examiner*—Kristine L. Kincaid

*Assistant Examiner*—Chau N. Nguyen

*Attorney, Agent, or Firm*—Hoffman, Wasson & Gitler

[57] ABSTRACT

An H-shaped compressible connector having a main body and two pairs of opposed legs extending in opposite directions from the main body. The H-shaped connector is designed to require a relatively small amount of compressive force to be applied to a crimping device to completely close the connector. In one embodiment, circular ribs or angular tips are provided on the distal portion of each of the legs.

8 Claims, 4 Drawing Sheets

RANGE ENHANCEMENT FOR H-SHAPED COMPRESSION CONNECTOR

BACKGROUND OF THE INVENTION

The field of this invention broadly pertains to electrical connectors for wires for cable conductors. More specifically, the invention relates to a compression-type electrical connector for connecting a first conductor to a second conductor in, for example, an electrical power distribution system. The present invention could be used in establishing a tap connection to provide a branch current from a continuous run power cable. An electrical connector of the aforesaid type is typically adapted to receive a tap conductor, to engage a continuous run conductor, and to be compressed by means of a crimping tool to achieve the desired connection.

Due to the fact that the various wires or conductors which would be connected in a connector are of varying diameters, it is important that a connector be developed which would be fully closed, after the crimping operation, around these variously sized wires and conductors.

U.S. Pat. Nos. 3,022,370 to Osborn; 3,088,993 to Mathysse et al; and 3,235,654 to Eldridge, Jr. are typical of prior art compression connectors. All three of these patents describe compression connectors having slots or channels for receiving wires and conductors therein, prior to the crimping process. Both the Osborn and Mathysse et al patents are provided with two slots or channels to receive wires and conductors therein. The configuration of each of these slots or channels is different to allow differently sized wires or conductors to be connected. Once these wires are provided within the respective slots or channels, the crimping process takes place.

The patent to Eldridge, Jr. shows a compression connector having two slots or channels which could be equally dimensioned. One or more tabs have been provided to enclose the wire therein. Although it is true that this connector is adapted for use with a great range of wire sizes, thereby reducing the number of fitting sizes needed to accommodate a given range of wire sizes, the fact that a tab must be utilized makes this connector more expensive and difficult to manufacture.

U.S. Pat. No. 5,162,615 issued to Schrader et al shows an H-shaped compressible connector having a main body and two pairs of opposed legs extending in opposite directions from the main body. Each pair of opposed legs is provided with one leg which is curved inwardly with respect to the second leg. During the crimping process, this curved leg would move below the interior surface of the second leg in each pair, thereby providing a completely closed connector for various conductor sizes.

However, the aforementioned prior art patents typically apply to connectors which are larger in size having thicker cross-sections requiring a relatively expensive hydraulic compression tool requiring 12 tons (24,000 lbs.) of crimping force to compress the connector down to the minimum application conductor size of #14 Awg Cu. and a maximum conductor size of #8 Awg Cu.

SUMMARY OFT HE INVENTION

The present invention overcomes the deficiencies of the prior art by providing an H-shaped connector which requires less of a crimping force to properly install the conductors therein. In one embodiment, circular ribs are provided close to the ends of each of the legs of the H-shaped connector. A second embodiment would include providing angular tips on each of the legs of the H-shaped connector.

The use of either of these embodiments would reduce the crimping force insulation to approximately 9,000 lbs. bringing the range of these new designs from #14 Awg Cu. thru #8 Awg Cu. to #14 AWG CU. thru #6 Awg Cu. It is important to note that the wire ranges are only one specific example. This invention may be used on wire ranges beyond those sited. Due to this lower insulation force, the H-shaped connector can be installed employing mechanical compression tools which are less costly and easier to operate than the hydraulic tools required for the prior art connectors. Therefore, this invention provides greater connection capacity with easier and less costly installation.

BRIEF DESCRIPTION OF THE DRAWINGS

The above and other advantages of the present invention will be made more apparent from the following specification taken in conjunction with the accompanying drawings, wherein like reference numerals refer to like parts and wherein.

DETAILED DESCRIPTION OF THE PREFERRED EMBODIMENTS

Figure 1:
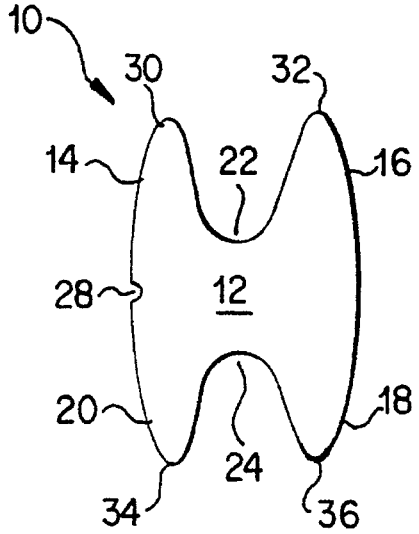
FIG. 1 PRIOR ART
FIG. 1 is a side elevational view of a prior art H-shaped connector.

FIGS. 1–4 illustrate a standard prior art H-shaped connector before and during the crimping process. As shown in FIG. 1, the prior art H-shaped connector 10 includes a main body portion 12 as well as legs 14, 16, 18 and 20 extending from the central body portion 12. A first channel 22 is formed between legs 14 and 16 and a second channel 24 is formed between legs 18 and 20. A longitudinal groove 28 is provided on one side of the main body portion 12 for the purpose of allowing a tie device to be included therein during the crimping process. It is noted that the tips 30, 32, 34 and 36 of the legs are rounded in this prior art H-shaped connector.

Figure 3:
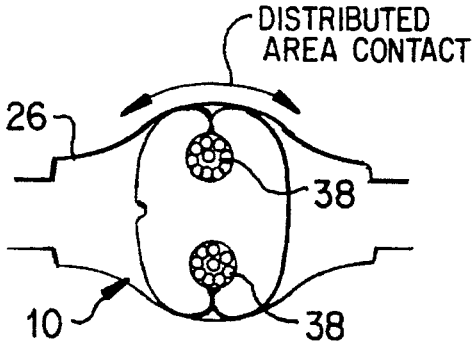
FIG. 3 PRIOR ART
FIG. 3 is a side elevational view of the H-shaped connector shown in FIG. 1 at the midpoint of the crimping process.
Figure 2:
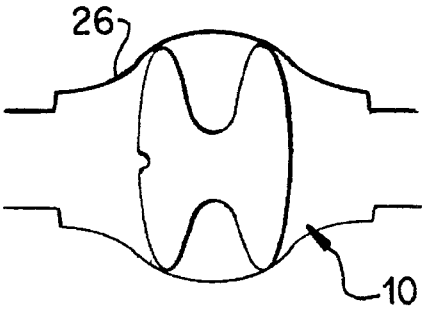
FIG. 2 PRIOR ART
FIG. 2 is a side elevational view of the connector in FIG. 1 shown in a crimping tool.
Figure 4:
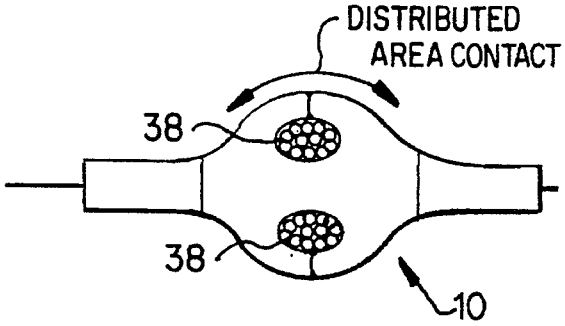
FIG. 4 PRIOR ART
FIG. 4 is a side elevational view of the connector shown in FIG. 1 after the connector has been completely crimped.

As particularly shown in FIGS. 3 and 4 which illustrate the H-shaped connector within a standard hydraulic crimping tool 26 during the midpoint of the compression as well as at the final crimp position, the use of the rounded tips 30, 32, 34 and 36 distributes the crimping force over the majority of the connector surface, thereby requiring a greater compressive force to complete the connection in which conductor strands 38 are provided within the channels 22 and 24.

Figure 5:
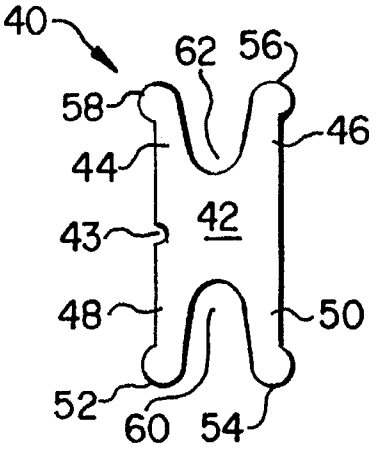
FIG. 5 is a side elevational view showing one embodiment of the present invention.
Figure 7:
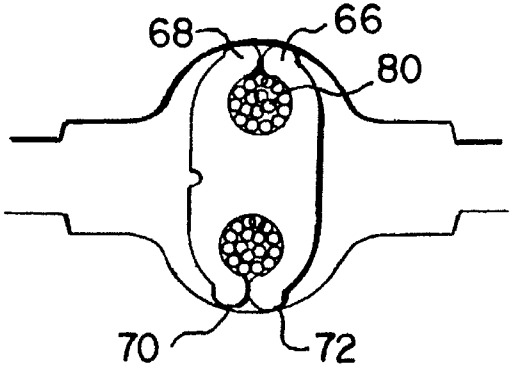
FIG. 7 is a side elevational view of the connector shown in FIG. 5 at the midpoint of the crimping process.
Figure 6:
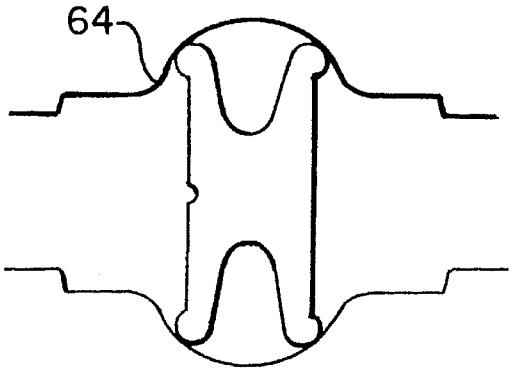
FIG. 6 is a side elevational view of a connector shown in FIG. 5 within a crimping tool.
Figure 8:
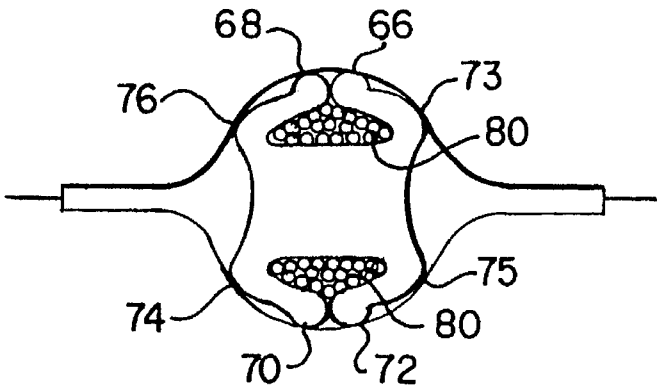
FIG. 8 is a side elevational view of the connector shown in FIG. 5 after the crimping process has been completed.
Figure 9:
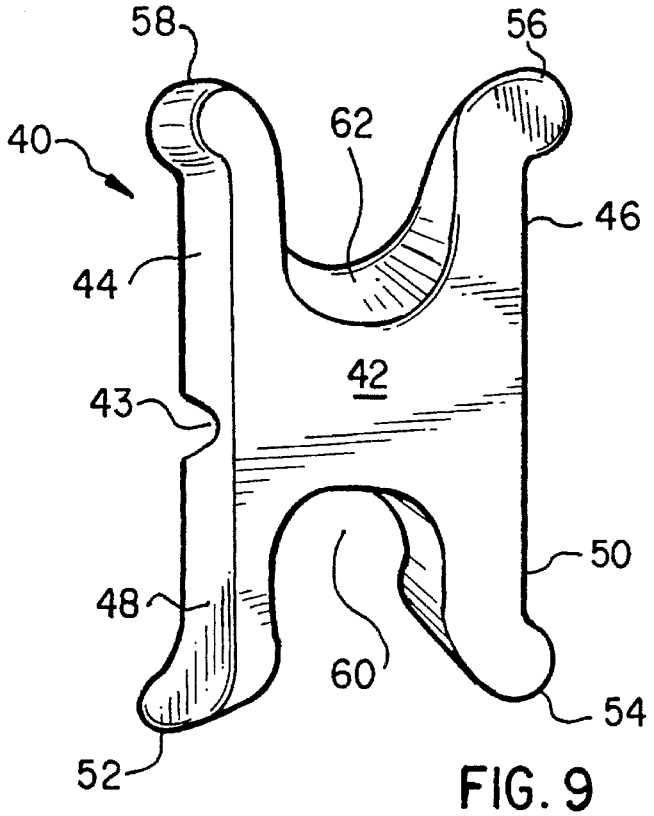
FIG. 9 is a perspective view of the connector shown in FIG. 5.
Figure 14:
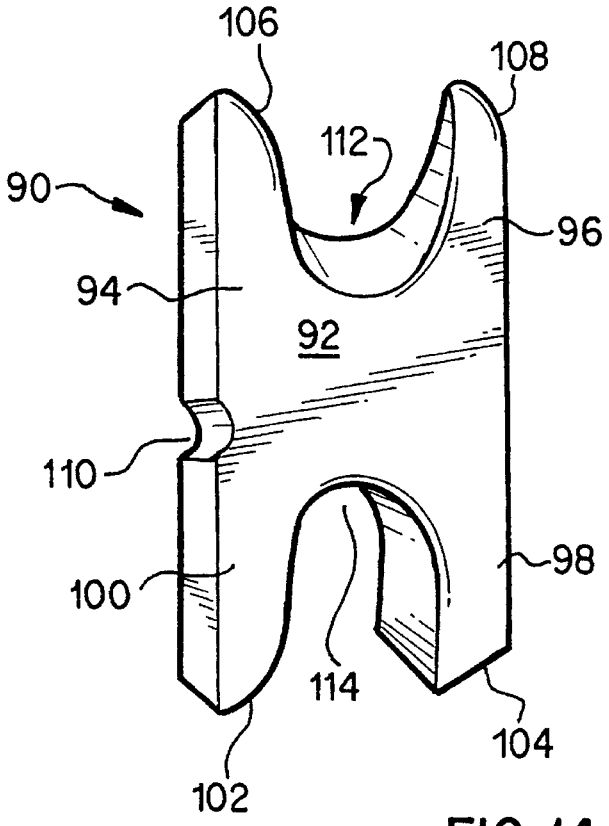
FIG. 14 is a perspective view of the connector shown in FIG. 10.
Figure 12:
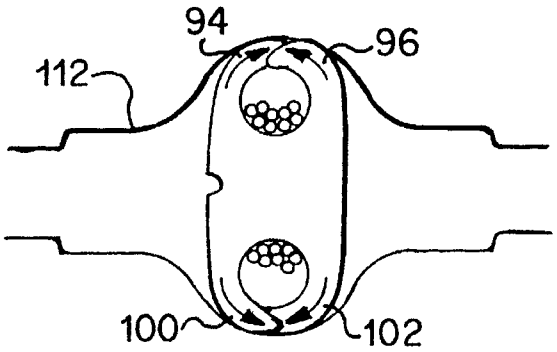
FIG. 12 is a side elevational view of the connector shown in FIG. 10 during the crimping process.

A first embodiment of the present invention is illustrated in FIGS. 5, 6, 7, 8 and 9. As shown in FIGS. 5 and 9, the H-shaped connector 40 according to the present invention, includes a central body portion 42 as well as four leg portions 44, 46, 48 and 50 extending from the main body portion to form channels 60 and 62 in which a plurality of conductors 80 can be placed. Longitudinal, circular ribs 52, 54, 56 and 58 extend for the entire width of each respective leg. These ribs are provided at the distal end of each respective leg. A longitudinal groove 43 extends for the width of the main body portion 42 and is adapted to receive a tie therein. As particularly shown in FIGS. 7 and 8, illustrating the H-shaped connector 40 when it is at the midpoint of compression as well as the final stage of compression within a crimping device 64, four distinct points of contacts 66, 68, 70 and 72 with the interior of the tool die surface of crimping device 64 optimizes the efficiency of the connection by reducing friction and orientating direction of the crimping force to gain leverage. Therefore, less force is required to effectuate the crimping operation. Furthermore, as particularly shown in FIG. 8, secondary points of contact 73, 74, 75 and 76 are made with the interior tool die surface.

Figure 13:
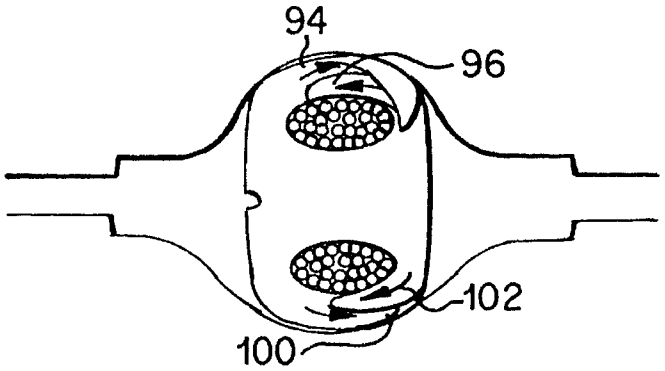
FIG. 13 is a side elevational view of the connector shown in FIG. 10 after the crimping process has been completed.
Figure 10:
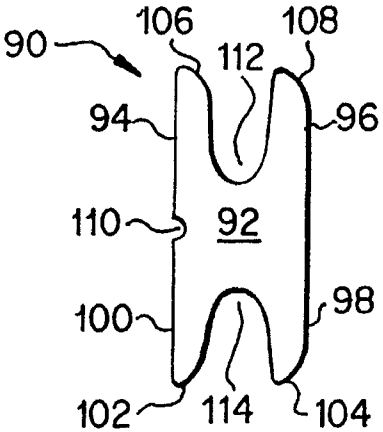
FIG. 10 is a side elevational view of a second embodiment of the present invention.
Figure 11:
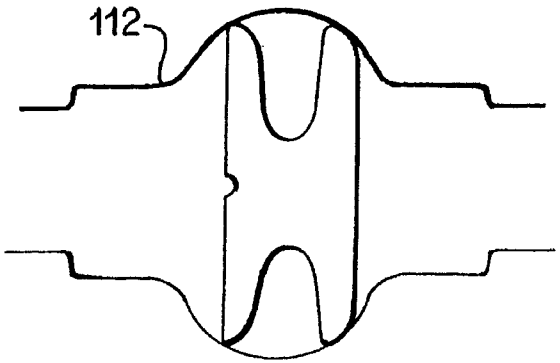
FIG. 11 is a side elevational view of the connector shown in FIG. 10 within a crimping tool.

A second embodiment of the present invention is illustrated with respect to FIGS. 10, 11, 12, 13 and 14. As shown in FIG. 10, an H-shaped connector 90 is provided with a central body portion 92 and four legs 94, 96, 98 and 100. Channels 112 and 114 are formed between each pair of legs. The distal ends of each of the legs is provided with angled tips 102, 104, 106 and 108, respectively. When placed in a die 112, and compressed, the tips of the legs will meet and then cross over each other and continue to compress until the crimp is finished as shown in FIG. 13. The angles of the tip have been designed to meet each other in opposite orientation at the base of the compressive dies. The tips 106 and 108 are both angled in a first direction and the tips 102 and 104 are both angled in a second direction opposite to that of tips 106 and 108. These tips can be angled in a range of approximately 35° to 55° with an optimum angle of 45°. This particular geometry would also provided a lower force insulation when compared to the prior art.

The drawings and specifications set forth the preferred embodiments of the present invention. Please note that while specific terms are employed, they are used in a generic and descriptive sense only, and not for purposes of limitation.

What is claimed is:

1. A compression connector capable of being deformed in a crimping device, comprising a body of compressive material formed in generally an H shape, said connector provided with a central body portion and first and second pairs of opposed parallel legs extending from said central body portion, each leg of said first pair of legs substantially equal in length to each other, and each leg of said second pairs of legs substantially equal in length to each other, each of said legs provided with a distal portion having tip portion, said first and second pairs of legs extending in opposite directions from said central body portion to form first and second channels therebetween, said tip portion of said distal portions of each of said legs provided with a means for reducing the amount of compressive force applied to the crimping device to completely close the connector around conductors provided in said first and second channels.

2. The compression connector in accordance with claim 1, wherein said means for reducing the amount of compressive force includes a rounded longitudinal rib provided on the exterior surface of each of said tip portions.

3. The compression connector in accordance with claim 1, wherein said means for reducing the amount of compressive force includes said tip portion of said distal portion of said legs of said first pair angled in a first direction and said tip portion of said distal portion of said legs of said second pair angled in a second direction opposite from said first direction.

4. The compression connection in accordance with claim 3, wherein each of said tip portions are angled in the range of 35° to 55°.

5. The compression connector in accordance with claim 2, wherein said means for reducing the amount of compressive force increases the range of the connector sizes.

6. The compression connector in accordance with claim 3, wherein said means for reducing the amount of compressive force increases the range of the connector sizes.

7. The compression connector in accordance with claim 2, wherein each of said longitudinal ribs creates a distinct point of contact at the midpoint of compression as well as during the final stage of compression when the connector is in the crimping device.

8. The compression connector in accordance with claim 3, wherein each of said tip portions is angled only in one direction.

* * * * *